US005135127A

United States Patent [19]

Ross

[11] Patent Number: 5,135,127

[45] Date of Patent: Aug. 4, 1992

[54] SMALL STORAGE CANISTER FOR RAW FOOD ARTICLES WITH IMPROVED AIRTIGHT COVERING MEMBERS

[76] Inventor: Gary Ross, 140 Oxnard Ave., Oxnard, Calif. 93035

[21] Appl. No.: 813,778

[22] Filed: Dec. 27, 1991

Related U.S. Application Data

[63] Continuation-in-part of Ser. No. 646,680, Jan. 28, 1991.

[51] Int. Cl.[5] ..... B65D 45/08

[52] U.S. Cl. ..... 220/322; 220/315; 220/324; 220/326; 220/377; 215/280; 215/285

[58] Field of Search ..... 220/322, 323, 324, 326, 220/375, 377, 380, 315; 215/280, 285

[56] References Cited

U.S. PATENT DOCUMENTS

| | | | |
|---|---|---|---|
| 233,195 | 10/1880 | Bradley . | |
| 282,188 | 7/1883 | Gilberds . | |
| 328,115 | 10/1885 | Gilberds . | |
| 380,091 | 3/1888 | Corey . | |
| 469,729 | 3/1892 | Van Vleck . | |
| 578,389 | 3/1897 | Challis . | |
| 835,497 | 11/1906 | Briggs . | |
| 1,124,910 | 1/1915 | Johnson et al. . | |
| 1,232,385 | 7/1917 | Palmer | 220/322 X |
| 1,452,558 | 4/1923 | Jackson . | |
| 1,483,953 | 2/1924 | Rainey . | |
| 1,486,336 | 3/1924 | Heusser . | |
| 1,532,585 | 4/1925 | Culver . | |
| 1,712,140 | 5/1929 | Flegenheimer . | |
| 1,932,221 | 10/1933 | Krause . | |
| 2,643,044 | 6/1953 | Sundholm . | |
| 2,661,974 | 12/1953 | Zehnder | 220/323 X |
| 3,122,990 | 3/1964 | Fried | 220/377 X |
| 3,236,402 | 2/1966 | Dellinger . | |
| 3,363,924 | 1/1968 | Remig . | |
| 3,397,935 | 8/1968 | Natsume | 220/377 X |
| 3,491,914 | 1/1970 | Elzey . | |
| 3,495,759 | 2/1970 | Bergstrom et al. | 220/377 X |
| 3,503,535 | 3/1970 | Sparks, Sr. . | |
| 3,695,233 | 10/1972 | Kovarik | 220/324 X |
| 3,746,205 | 7/1973 | Helguera . | |
| 3,817,563 | 6/1974 | McGlothlin . | |
| 4,196,487 | 4/1980 | Merriman et al. . | |
| 4,667,856 | 5/1987 | Nelson . | |

*Primary Examiner*—Stephen Marcus
*Assistant Examiner*—Vanessa Caretto
*Attorney, Agent, or Firm*—Thomas I. Rozsa

[57] ABSTRACT

The present invention is an airtight canister. The airtight canister comprises a ceramic container and an acrylic cover. The ceramic container has an open top, a bottom and an annular groove adjacent to the bottom. The acrylic cover is secured on the ceramic container by an elongated cord and a wave-shaped hook. The elongated cord has two ends interconnected by a coil spring which creates a tension on the cord, and the hook is linked to the cord between its two ends. A generally "π"-shaped member is mounted on the cover and has an inner chamber for retaining the coil spring and the two ends of the elongated cord. When the cover is placed onto the open top of the container and the hook is retained by the annular groove adjacent to the bottom of the container, the tension on the cord created by the coil spring will remain a pressure on the cover through the connecting member, which in turn creates an airtight coverage.

22 Claims, 2 Drawing Sheets

(Section on line 9 - 9)

SMALL STORAGE CANISTER FOR RAW FOOD ARTICLES WITH IMPROVED AIRTIGHT COVERING MEMBERS

This is a continuation-in-part of patent application Ser. No. 07/646,680 filed on Jan. 28, 1991, now copending.

BACKGROUND OF THE INVENTION

1. Field of the Invention

The present invention relates to the field of small storage canisters for raw food articles. More particularly the present invention relates to the field of small airtight storage canisters for raw food articles.

2. Description of the Prior Art

Small storage canisters are often used in kitchens for storing raw food articles such as flour, sugar, granola and coffee beans. One important criteria for those canisters is whether it is airtight or not. Some raw food articles, such as coffee beans, are better stored under airtight conditions to preserve their preferred qualities including natural flavors, freshness, and sometimes even, dryness.

Airtight and non-airtight canisters are very different. Airtight canisters usually require a more complicated closure mechanism to ensure the airtightness. Although airtight canisters are made of many kinds of materials, including ceramic, wood, glass and acrylic, with numerous variations in their shapes and sizes, there are only a few different mechanical designs for the airtight closure means currently available on the market.

A typical covered canister comprises a container and a cover. The container and the cover are often made of the same material such as ceramic, wood, glass and acrylic. The container is usually cylindrical shaped with a closed bottom and an open top. For non-airtight canisters the cover is merely resting over the open top of the container. For airtight canisters, the cover cannot just rest on the open top of the container. One way to ensure the airtightness is to add a sealing gasket or washer between the cover and the open top of the container. Another way to ensure the air-tightness is to employ some kind of mechanical means to tightly attach the cover to the open top of the container.

Although there are many mechanical means available, the application of the small airtight canisters as normal housewares requires that the mechanical means be simple and easy to produce and operate. There are two common types of conventional airtight covering means commonly used for small housewares. One common type of conventional airtight canister utilizes various types of screw means for attaching the cover and the container. The disadvantage of this type of canister closure that it requires extra effort to operate the screw means. Another common type of conventional airtight canister closure mechanism comprises a wire around the cover and another wire around the open top of the container. The two wires are usually metal wires. At the front of the canister the two wires are attached by a leverage tab which also can be made of metal wires. At the rear of the canister the two wires are either hingeably attached by a hinged means or detachably attached by another leverage tab. The disadvantage of this type of conventional canister closure mechanism is that the leverage tabs are sometimes difficult to use, especially for those elderly people with less strength in their hands.

The following prior art patents are found to be relevant to the present invention:

1. U.S. Pat. No. 233,195 issued to Bradley on Oct. 12, 1980 for "Butter Package" (hereafter the "Bradley Patent").

2. U.S. Pat. No. 282,188 issued to Gilberds on Jul. 31, 1883 for "Fruit Jar" (hereafter the "First Gilberds Patent").

3. U.S. Pat. No. 328,115 issued to Gilberds on Oct. 13, 1885 for "Fruit Jar Cover" (hereafter the "Second Gilberds Patent").

4. U.S. Pat. No. 380,091 issued to Corey on Mar. 27, 1888 for "Jar or Bottle for Fruit, Milk &c." (hereafter the "Corey Patent").

5. U.S. Pat. No. 469,729 issued to Van Vleck on Mar. 1, 1892 for "Butter Jar" (hereafter the "Van Vleck Patent").

6. U.S. Pat. No. 578,389 issued to Challis on Mar. 9, 1897 for "Cooking Utensil" (hereafter the "Challis Patent").

7. U.S. Pat. No. 835,497 issued to Briggs on Nov. 13, 1906 for "Bottle Stopper Holding Device" (hereafter the "Briggs Patent").

8. U.S. Pat. No. 1,124,910 issued to Johnson et al. on Jan. 12, 1915 for "Electrical Heater" (hereafter the "Johnson Patent").

9. U.S. Pat. No. 1,452,558 issued to Jackson on Apr. 24, 1923 for "Cover for Food Receptacles" (hereafter the "Jackson Patent").

10. U.S. Pat. No. 1,483,953 issued to Rainey on Feb. 19, 1924 for "Cap for Liquid Receptacles" (hereafter the "Rainey Patent").

11. U.S. Pat. No. 1,486,336 issued to Heusser on Mar. 11, 1924 for "Milk Can Cover" (hereafter the "Heusser Patent").

12. U.S. Pat. No. 1,532,585 issued to Culver on Apr. 7, 1925 for "Fastening Device for jar Tops" (hereafter the "Culver Patent").

13. U.S. Pat. No. 1,712,140 issued to Flegenheimer on May 7, 1929 for "Display Lid for Containers" (hereafter the "Flegenheimer Patent").

14. U.S. Pat. No. 1,923,221 issued to Krause on Oct. 24, 1933 for "Coffee Container" (hereafter the "Krause Patent").

15. U.S. Pat. No. 2,643,044 issued to Sundholm on Jun. 23, 1953 for "Crease Gun Loading Pail Base for Grease Containers with Cutter and Interlock Means for Said Containers" (hereafter the "Sundholm Patent").

16. U.S. Pat. No. 3,236,402 issued to Dellinger on Feb. 22, 1966 for "Jar, and Closure and Handle Means Therefor" (hereafter the "Dellinger Patent").

17. U.S. Pat. No. 3,363,924 issued to Remig on Jan. 16, 1968 for "Releasable Tension Holder for Removable Receptacle Covers" (hereafter the "Remig Patent").

18. U.S. Pat. No. 3,491,914 issued to Elzey on Jan. 27, 1970 for "Expanded Plastic Container Having Rigid Internally Press-fit Cover" (hereafter the "Elzey Patent").

19. U.S. Pat. No. 3,503,535 issued to Sparks, Sr. on Mar. 31, 1970 for "Garbage Can Lid Anchoring Attachment" (hereafter the "Sparks Patent").

20. U.S. Pat. No. 3,746,205 issued to Helguera on Jul. 17, 1973 for "Thermic Pot" (hereafter the "Helguera Patent").

21. U.S. Pat. No. 3,817,563 issued to McGlothlin on Jun. 18, 1974 for "Can Top Lock" (hereafter the "McGlothlin Patent").

22. U.S. Pat. No. 4,196,487 issued to Merriman et al. on Apr. 8, 1980 for "Eyeglass Washer" (hereafter the "Merriman Patent").

23. U.S. Pat. No. 4,667,856 issued to Nelson on May 26, 1987 for "Dispenser for Attachment to Liquid Containers" (hereafter the "Nelson Patent").

The above-referenced prior art patents are generally related to retaining or locking means for container covers. Most of the prior art retaining or locking means utilize metal wires or wire frames. Some of them have utilized flexible or elastic cords.

The Remig Patent utilizes two small rings 26 for retaining the two small hooks 42 respectively. The two small rings are pivoted on the opposite sides of the container by respective bearing plates 24, which bearing plates themselves in turn must be mounted to the container. The Remig Patent container has to have these extra bearing plates and receiving rings. In addition, the Remig patent utilizes two separate cords with two respective hooks and a user has to release both hooks to open the cover. Furthermore, the two cords used in the Remig Patent are "loop bodies".

The Dellinger Patent discloses a container 10 and a cover 14 both made of ceramic material. The cover 14 of the Dellinger Patent is secured on the container 10 by a metal wire 20 attached to the container 10 and a metal wire 22 attached to the cover 14.

The Elzey Patent discloses a chest-type plastic container 1 having a rectangular shaped flat cover 8 which is made of acrylic material. The cover 8 is press-fit with the container 1.

The Krause Patent discloses a coffee container 10 having a circular channel 11 adjacent to its top opening. A resilient circular ring 13 is placed within the channel 11, so that when a cover 16 is placed on the container 10, the resilient circular ring 13 helps to create an airtight coverage. The Krause Patent cover 16 is fastened to the container 10 by two metal clips 20 and 27. Furthermore, the Krause Patent resilient circular ring 13 is attached to the container 10 but not the cover 16.

Recently there is a new design airtight canister with the trade name CLICK CLACK. It has two mechanical squeezable tabs in the center of a cover tightly fitted on a container which, when squeezed, reduces the diameter of the cover to therefore allow it to be removed from the container. This product is available only in acrylic. The drawback, however, is that for some kinds of raw food articles the canisters made of acrylic are not suitable. For example, acids in coffee beans can hurt the surface of acrylic containers. It is preferable to use traditional glass or ceramic containers which resist harsh materials in some raw food articles.

SUMMARY OF THE PRESENT INVENTION

The present invention is a small storage canister for raw food articles with special airtight covering means.

It is known that airtight coverage is preferred for many kinds of small canisters used for storing raw food articles. An airtight canister used for normal housewares typically comprises a container and a cover, and mechanical covering means for tightly securing the cover to the container. In addition, a sealing gasket is often utilized with the cover to ensure the tight fit. However, the various types of small airtight canisters used for normal housewares currently available on the market have their respective drawbacks.

It has been discovered, according to the present invention, that if a pressure is maintained on the cover which pushes the cover against the open top of the container with a resilient gasket therein between, then the coverage can be maintained airtight.

It has also been discovered, according to the present invention, that if an elastic cord is connected at its two ends to the cover by a connecting means and hooked down at its middle point to the container at a location adjacent to the bottom of the container by a hooking means, then a downward pressure can be maintained on the cover which pushes it against the open top of the container.

It has further been discovered, according to the present invention, that if the two ends of the elastic cord are attached to the cover through a connecting means which contacts the cover at two spaced apart locations along a diameter of the cover, then the downward pressure on the cover is evenly distributed on the cover which in turn ensures the airtight fitting among the cover, the gasket and the container.

It has additionally been discovered, according to the present invention, that if an annular shelf with outer annular lip is configured at the open top of the container, then the cover can be securely placed on the annular shelf and guarded by the annular lip.

It has additionally been discovered, according to the present invention, that if an annular groove is configured at the bottom of the container, then the hooking means can be hooked into the annular groove without extra loop means for the hooking means.

It has further been discovered, according to the present invention, that if the member connecting the elastic cord and the cover is a generally "$\pi$"-shaped member, then the connection between the elastic cord and the cover is more stable and secure.

It has also been discovered, according to the present invention, that if a coil spring is connected between the two opposite ends of an elongated cord, then the elongated cord itself does not have to be elastic because the coil spring can create a tension on the elongated cord.

It has additionally been discovered, according to the present invention, that if the member connecting the elastic cord and the cover has a hollow chamber, then the coil spring interconnecting the two opposite ends of an elongated cord can be retained inside the hollow chamber.

It is therefore an object of the present invention to provide a small storage canister for raw food articles with special airtight covering means comprising a container, a cover and a resilient gasket wherein a pressure is maintained on the cover which pushes the cover against the open top of the container with the gasket therein between, so that the coverage can be maintained airtight.

It is also an object of the present invention to provide a small storage canister for raw food articles with special airtight covering means comprising an elastic cord and a hook wherein the elastic cord is attached at its two ends to the cover by a connecting means and hooked down at its middle point to the container at a location adjacent to the bottom of the container by the hook, so that a downward pressure can be maintained on the cover which pushes it against the open top of the container.

It is a further object of the present invention to provide a small storage canister for raw food articles with special airtight covering means comprising a connecting means wherein the two ends of the elastic cord are attached to the cover through the connecting means which contacts the cover at two spaced apart locations along a diameter of the cover, so that the downward pressure on the cover is evenly distributed on the cover which in turn ensures the airtight fitting among the cover, the gasket and the container.

It is a further object of the present invention to provide a small storage canister for raw food articles with special airtight covering means wherein an annular shelf with outer annular lip is configured at the open top of the container, so that the cover can be securely placed on the annular shelf and guarded by the annular lip.

It is a further object of the present invention to provide a small storage canister for raw food articles with special airtight covering means wherein an annular groove is configured at the bottom of the container, so that the hooking means can be hooked into the annular groove without extra loop means for the hooking means.

It is also an object of the present invention to provide a small storage canister for raw food articles with special airtight covering means wherein the body of the canister, e.g. the container, is made of acid resistant material such as ceramic, so that the canister can be used for storage of all kinds of raw food articles including coffee beans.

It is also an object of the present invention to provide a small storage canister for raw food articles with special airtight covering means wherein the cover of the canister is made of transparent material such as acrylic or glass, so that the contents of the canister can be seen without opening the cover.

It is a further object of the present invention to provide a small storage canister for raw food articles with special airtight covering means wherein the member connecting the elastic cord and the cover is a generally "$\pi$"-shaped member, so that the connection between the elastic cord and the cover is more stable and secure.

It is also an object of the present invention to provide a small storage canister for raw food articles with special airtight covering means wherein a coil spring is connected between the two opposite ends of an elongated cord, so that the elongated cord itself does not have to be elastic because the coil spring can create a tension on the elongated cord.

It is an additional object of the present invention to provide a small storage canister for raw food articles with special airtight covering means wherein the member connecting the elastic cord and the cover has a hollow chamber, so that the coil spring interconnecting the two opposite ends of an elongated cord can be retained inside the hollow chamber.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
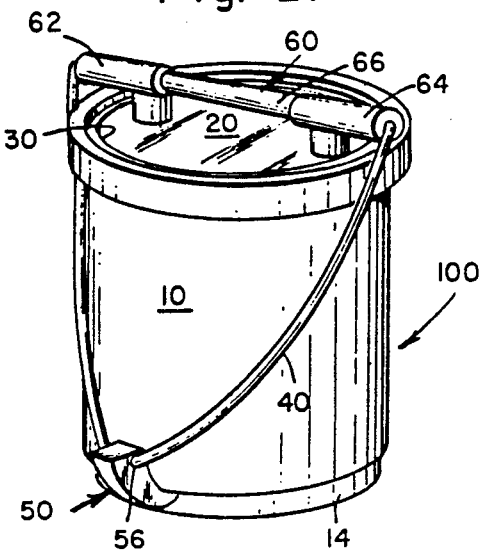
FIG. 1 is a perspective view of the present invention small storage canister for raw food articles with special airtight covering means.

Referring to FIG. 1, there is shown at 100 an airtight canister of the present invention. Airtight canister 100 comprises a generally cylindrical shaped container 10, a generally round disk shaped cover 20, an annular resilient gasket 30, an elongated elastic cord 40, a wave shaped hook 50 slidably linked to cord 40, and a generally "$\pi$"-shaped connecting means 60. A perspective view of container 10 is shown in FIG. 2, and a perspective view of cover 20 attached with connecting means 60 is shown in FIG. 4.

Figure 2:
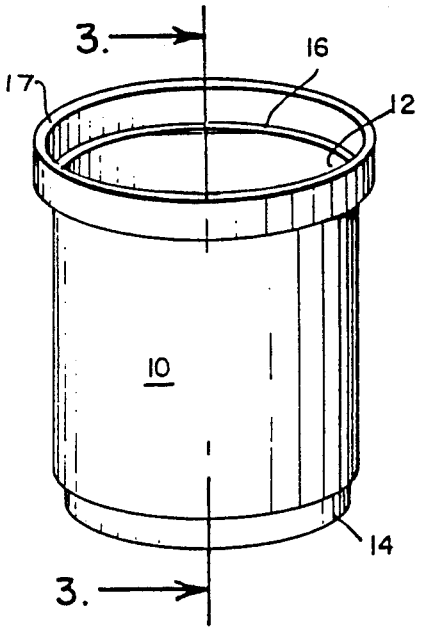
FIG. 2 is a perspective view of the container body of the canister of the present invention small storage canister for raw food articles.
Figure 3:
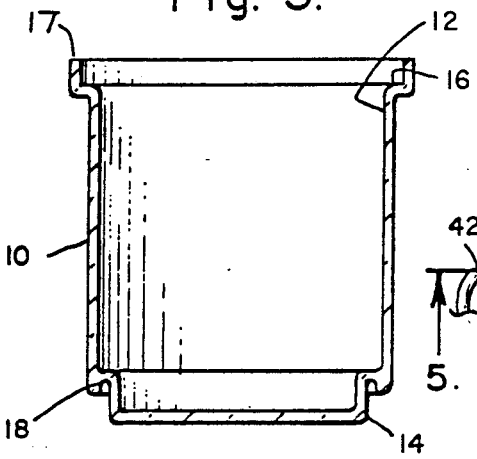
FIG. 3 is a partial cross-sectional view taken along line 3—3 of FIG. 2.

Referring to FIG. 2, container 10 has an open top 12 and a bottom 14. A cross-sectional view of container 10 taken along line 3—3 of FIG. 2 is shown in FIG. 3. As FIG. 3 shows in detail, container 10 further has an annular shelf 16 adjacent to open top 12 for receiving cover 20, an annular lip 17 surrounding annular shelf 16 to guard cover 20, and an annular groove 18 adjacent to bottom 14 for receiving hook 50. The special configuration of container 10 has the following benefits: (a) annular shelf 16 ensures that cover 20 is suitably fitted on open top 12 of container 10 (b) annular lip 17 prevents cover 20 from slipping off open top 12 of container 10; (c) annular groove 18 eliminates the need for having extra separate means for receiving hook 50; and (d) many containers can be efficiently stacked together for shipping. Container 10 is preferably made of ceramic material for its resisting harsh substances such as acid contained in some raw food articles such as coffee beans.

Figure 4:
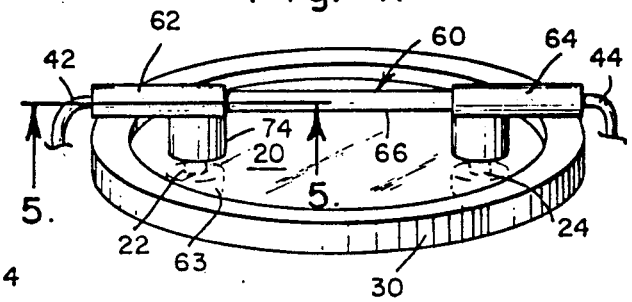
FIG. 4 is a perspective view of the special airtight covering means of the present invention small storage canister for raw food articles.
Figure 5:
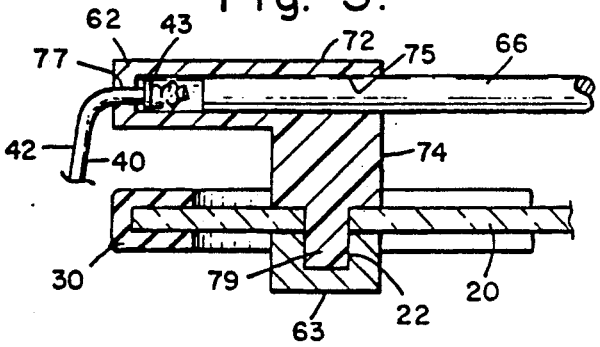
FIG. 5 is a cross-sectional view taken along line 5—5 of FIG. 4.

Referring to FIG. 4, cover 20 is a thin round disk having an annular rim wrapped by annular resilient gasket 30. There are two small through holes 22 and 24 on cover 20 located at two spaced apart locations along a diameter of cover 20. Generally "$\pi$"-shaped connecting means 60 is attached onto cover 20 and connected with two ends 42 and 44 of elongated elastic cord 40. Connecting means 60 is detachably assembled by two generally "L"-shaped joints 62 and 64 and a cross bar 66. FIG. 5 is a partial cross-sectional view taken along line 5—5 of FIG. 4, which shows half of the attachment shown in FIG. 4. The other half is similar to the shown half. Referring to FIG. 5, generally "L"-shaped joint 62 has a hollow portion 72 and a stand portion 74. Hollow portion 72 has a large opening 75 at one end to retain cross bar 66, and a small opening 77 at the other end to retain one of the two ends, end 42, of elastic cord 40. When end 42 of cord 40 is pierced through small opening 77 the tip of cord 40 is clamped by a metal band 43 which is wider than the diameter of small opening 77 so end 42 of cord 40 is attached to joint 62. Stand portion 74 of joint 62 has a narrower tip 79 which is adapted to go through one of the two small holes, hole 22, of cover 20, and then affixed by a snap-on piece 63 to secure the connection. FIG. 5 also shows how annular resilient gasket 30 is wrapped onto the annular rim of cover 20.

In the preferred embodiments of the present invention, cover 20 is made of transparent acrylic material, gasket 30 is made of rubber material, joints 62 and 64, and are made of plastic material, cross bar 66 is made of any material including wood or plastic. Acrylic cover is unbreakable, durable and easy to clean. It is transparent so that the contents stored inside the canister can be viewed without opening the cover. The components of the present invention canister assembly can also be made of other suitable materials. For example, cover 20 can be made of glass material as well.

Figure 6:
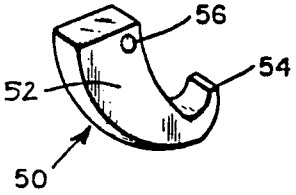
FIG. 6 is a perspective view of the hooking means of the special airtight covering means of the present invention small storage canister for raw food articles.

Wave shaped hook 50 is shown in FIG. 6. Hook 50 has a wave shaped body portion 52 adapted to be held easily, a hook portion 54 adapted to hook into annular groove 18 adjacent to bottom 14 of container 10, and a through hole 56 remote from hook portion 52 for linking with elastic cord 40 at a location between its two ends 42 and 44. Hook 50 is preferably made of plastic, but other material may be utilized. Body portion 52 of hook 50 may also be configured in other shapes.

The present invention canister is readily assembled such that everything other than container 10 is attached as a whole covering means as described earlier. To use the present invention canister, after raw food articles are poured into container 10, the whole covering means is placed on open top 12 of container 10 such that the annular rim of cover 20, which is wrapped by annular gasket 30, rests on annular shelf 16. By pushing down hook 50 to clasp it to annular groove 18 at bottom 14 of container 10, the tension in elastic cord 40 maintains a downward pressure on cover 20 through connecting means 60, which is turn creates an airtight coverage. Resilient gasket 30 helps the sealing, and is further resistant to the slipping of cover 20. Also, annular lip 17 surrounding annular shelf 16 at open top 12 of container 10 will prevent cover 20 from slipping off open top 12 of container 10. To view the contents, the whole covering means does not need to be removed since cover 20 is clear. To access the contents, the whole covering means can be easily removed by simply pushing down hook 50 again to release it from annular groove 18 at bottom 14 of container 10. The whole covering means can be removed from open top 12 of container 10, so the contents can be poured out. This feature is not available for some prior art canisters wherein the cover is hinged to the container. Also operating the elastic cord and hook is easier and requires less strength for elderly people than some prior art canisters wherein the closing mechanism involves a leverage tab made of metal wires.

The present invention has many advantageous features including: (a) it is easy to operate; (b) it is made of durable materials for long lasting use; (c) the container is made of ceramic which is resistant to harsh materials; (d) the cover is made of acrylic which is unbreakable and transparent; (e) when opened the cover is completely detached and removable which makes it more convenient to pour the contents out; (f) the design of the container allows the container to be stacked, which makes it more efficient to transport the container.

A further object of the present invention is to provide a small storage canister for raw food articles with special airtight covering means wherein the generally "π"-shaped member connecting the elastic cord and the cover has an inner chamber for retaining a coil spring, which is connected between the two opposite ends of an elongated cord, so that the elongated cord itself does not have to be elastic because the coil spring can create a tension on the elongated cord.

Figure 7:
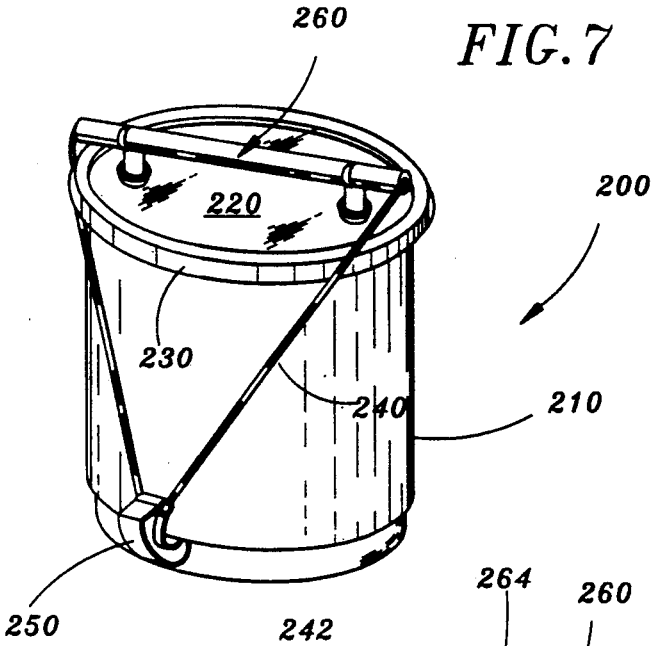
FIG. 7 is a perspective view of an alternative embodiment of the present invention small storage canister for raw food articles with special airtight covering means.

Referring to FIG. 7, there is shown at 200 an alternative embodiment of the airtight canister of the present invention. The alternative embodiment of the airtight canister 200 comprises a generally cylindrical shaped container 210, a generally round disk shaped cover 220, an annular resilient gasket 230, an elongated cord 240, a wave shaped hook 250 slidably linked to cord 240, and a generally "π"-shaped connecting means 260. The container 210, the cover 220, the gasket 230 and the hook 250 are respectively similar to the container 10, the cover 20, the gasket 30 and the hook 50 shown in the previous FIGS. 1 through 6.

Figure 8:
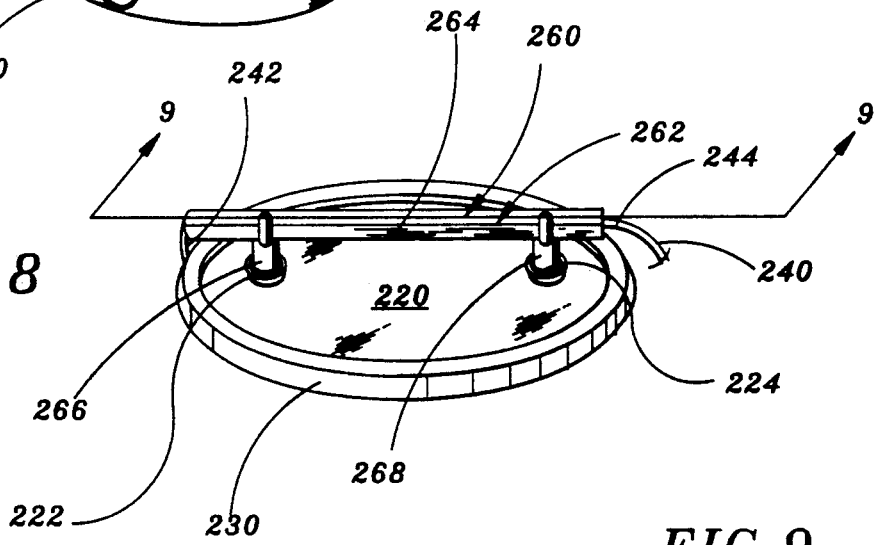
FIG. 8 is a perspective view of the alternative embodiment of the special airtight covering means of the present invention small storage canister for raw food articles.
Figure 9:
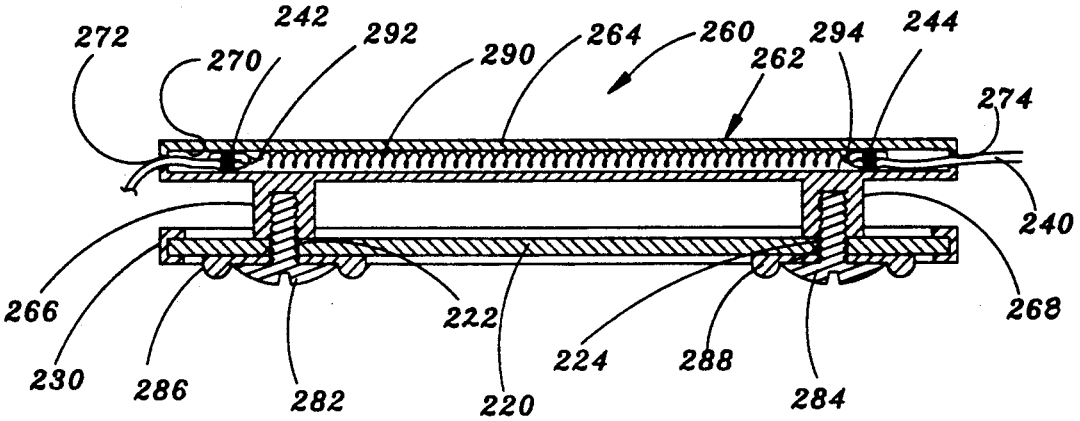
FIG. 9 is a cross-sectional view taken along line 9—9 of FIG. 8.

Referring to FIGS. 8 and 9, the changes of the alternative embodiment 200 of the present invention airtight canister is reflected in the generally "π"-shaped connecting member 260 and the elongated cord 240. Instead of being detachably assembled by the two generally "L"-shaped joints 62 and 64 and a cross bar 66, the crossing bar portion 262 of the generally "π"-shaped connecting member 260 is now integrally connected with the two standing joint portions 266 and 268. The two standing joint portions 266 and 268 are fastened to the cover 220 by two screws 282 and 284. The cover 220 again has two spaced apart small openings 222 and 224 for allowing the two screws 282 and 284 to run through cover 220, respectively. Two washers 286 and 288 are used respectively with the two screws 282 and 284. Moreover, the crossing bar portion 262 of the generally "π"-shaped connecting member now has an elongated inner chamber 270 which has two narrow openings 272 and 274 at its two opposite ends. A coil spring 290 is retained in the inner chamber 270. The coil spring 290 has two opposite end 292 and 294. When the two opposite ends 242 and 244 of the elongated cord 240 are pierced through the two narrow end openings 272 and 274 respectively and enter into the inner chamber 270, the two opposite end 292 and 294 of the coil spring 290 are connected to the two opposite ends 242 and 244 of the elongated cord 240 respectively. When the two opposite ends 242 and 244 of the cord 240 are tied to the two opposite ends 292 and 294 of the coil spring 290, they are widened so they cannot be pulled through the two narrow end openings 272 and 274 of the inner chamber 270. Since the coil spring 290 can create a tension on the elongated cord 240, the cord 240 itself does not have to be elastic.

One of the advantages of this alternative embodiment of the present invention is that the coil spring 290 may create a greater tension than an elastic cord and therefore provides a tighter coverage to the small canister. Another advantage is that the crossing bar portion 264 and the two standing joint portions 266 and 268 of the generally "π"-shaped connecting means 260 are now integrally connected, thus providing a more stable attachment between the elongated cord and the cover. Still another advantage is that the two standing joint portions 266 and 268 are now fastened with the cover by screws 282 and 284, which is more secure than the snap-on pieces 63.

Defined in detail, the alternative embodiment of the present invention is an airtight canister comprising: (a) a generally cylindrical shaped container having an open top, a bottom, an annular shelf adjacent to the open top, and an annular groove adjacent to the bottom; (b) a round disk shaped transparent cover having an annular rim and two spaced apart openings; (c) an annular resilient gasket wrapped onto the annular rim of said cover; (d) an elongated cord having two opposite ends interconnected by a coil spring which creates an elastic tension; (e) a wave shaped hook slidably linked to said cord between said two opposite ends; and (f) a connecting means having a generally "π"-shaped member, the generally "π"-shaped member comprising a crossing bar portion and two spaced apart standing joint portions, the crossing bar portion having an inner chamber for retaining said coil spring and said two opposite ends of said elongated cord, the two standing joint portions being integrally connected with the crossing bar portion, where the two standing joint portions are mounted to said cover by two screws respectively extending through said two spaced apart openings on said cover; (g) whereby when said cover is placed onto the annular shelf adjacent to the open top of said container and said wave shaped hook is retained by the annular groove adjacent to the bottom of said container, the tension on said cord created by said coil spring will maintain a pressure on said cover through said connecting means, which in turn creates an airtight coverage, and the airtight coverage is further ensured by said resilient gasket.

Defined broadly, the alternative embodiment of the present invention is an airtight canister comprising: (a) a container having an open top, a bottom and an annular groove adjacent to the bottom; (b) a cover; (c) an elongated cord having two ends interconnected by a coil spring which creates a tension; (d) a hook linked to said cord between the two ends; and (e) a connecting member mounted on said cover and having an elongated inner chamber for retaining said coil spring and said two ends of said elongated cords; (f) whereby when said cover is placed onto the open top of said container and said hook is retained by the annular groove adjacent to the bottom of said container, the tension on said cord created by said coil spring will remain a pressure on said cover through said connecting member, which in turn creates an airtight coverage.

Defined more broadly, the alternative embodiment of the present invention is an airtight canister comprising: (a) a container having an open top and an annular groove remote from the open top; (b) a cover; (c) a flexible fastening loop having a non-elastic portion and an elastic portion which has an elastic tension; (d) a connecting means connecting at least one portion of said flexible fastening loop to said cover; and (e) a retianing means attached to said flexible fastening loop at another portion remote from said at least one portion of said flexible fastening loop; (f) whereby when said cover is placed onto the open top of said container and said retaining means is retained by said annular groove of said container, the tension of said flexible fastening loop will maintain a pressure on said cover which in turn creates an airtight coverage.

Defined even more broadly, the alternative embodiment of the present invention is an airtight canister comprising: (a) a container having an open top and an annular groove remote from the top; (b) a cover; (c) a connecting means attached to said cover; (d) an elongated cord having two ends elastically attached to said connecting means such that a tension is created on the cord; and (e) a retaining means attached to said cord at a portion between said two ends; (f) whereby when said cover is placed onto the open top of said container and said retaining means is retained by said annular groove of said container, the tension of said elongated cord will maintain a pressure on said cover which in turn creates an airtight coverage.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An airtight canister comprising:

a. a generally cylindrical shaped container having an open top, a bottom, an annular shelf adjacent to the open top, and an annular groove adjacent to the bottom;

b. a round disk shaped transparent cover having an annular rim and two spaced apart openings;

c. an annular resilient gasket wrapped onto the annular rim of said cover;

d. an elongated cord having two opposite ends interconnected by a coil spring which creates an elastic tension;

e. a wave shaped hook slidably linked to said cord between said two opposite ends; and f. a connecting means having a generally "π"-shaped member, the generally "π"-shaped member comprising a crossing bar portion and two spaced apart standing joint portions, the crossing bar portion having an inner chamber for retaining said coil spring and said two opposite ends of said elongated cord, the two standing joint portions being integrally connected with the crossing bar portion, where the two standing joint portions are mounted to said cover by two screws respectively extending through said two spaced apart openings on said cover;

g. whereby when said cover is placed onto the annular shelf adjacent to the open top of said container and said wave shaped hook is retained by the annular groove adjacent to the bottom of said container, the tension on said cord created by said coil spring will maintain a pressure on said cover through said connecting means, which in turn creates an airtight coverage, and the airtight coverage is further ensured by said resilient gasket.

2. The canister as defined in claim 1 wherein said container further comprises an annular lip at the open top integrally extending upwardly from the annular shelf to guard said cover placed on the annular shelf.

3. The canister as defined in claim wherein said container is made of ceramic material.

4. The canister as defined in claim 1 wherein said cover is made of acrylic material.

5. The canister as defined in claim 1 wherein said gasket is made of rubber material.

6. The canister as defined in claim 1 wherein said hook is made of plastic material.

7. The canister as defined in claim 1 wherein said generally "$\pi$"-shaped member of said connecting means ia made of plastic material.

8. The canister as defined in claim 1 wherein said connecting means further comprising two washers respectively used in conjunction with said two screws.

9. An airtight canister comprising:

a. a container having an open top, a bottom and an annular groove adjacent to the bottom;

b. a cover;

c. an elongated cord having two ends interconnected by a coil spring which creates a tension;

d. a hook linked to said cord between the two ends; and e. a connecting member mounted on said cover and having an elongated inner chamber for retaining said coil spring and said two ends of said elongated cord;

f. whereby when said cover is placed onto the open top of said container and said hook is retained by the annular groove adjacent to the bottom of said container, the tension on said cord created by said coil spring will maintain a pressure on said cover through said connecting member, which in turn creates an airtight coverage.

10. The canister as defined in claim 9 wherein said container is made of ceramic material.

11. The canister as defined in claim 9 wherein said cover is made of acrylic material.

12. The canister as defined in claim 9 wherein said hook is made of plastic material.

13. The canister as defined in claim 9 further comprising an annular resilient gasket positioned between said cover and the open top of said container.

14. The canister as defined in claim 13 wherein said gasket is made of rubber material.

15. The canister as defined in claim 9 wherein said connecting member is generally "$\pi$"-shaped which has a longitudinal shaft portion and two transversal stand portions, where the two transversal stand portions are integrally connected with the longitudinal shaft portion and further mounted to said cover at two spaced apart locations.

16. An airtight canister comprising:

a. a container having an open top and an annular groove remote from the open top;

b. a cover;

c. a flexible fastening loop having a non-elastic portion and an elastic portion which has an elastic tension;

d. a connecting means connecting at least one portion of said flexible fastening loop to said cover; and e. a retaining means attached to said flexible fastening loop at another portion remote from said at least one portion of said flexible fastening loop;

f. whereby when said cover is placed onto the open top of said container and said retaining means is retained by said annular groove of said container, the tension of said flexible fastening loop will maintain a pressure on said cover which in turn creates an airtight coverage.

17. The canister as defined in claim 16 wherein said container is made of ceramic material.

18. The canister as defined in claim 16 wherein said cover is made of acrylic material.

19. The canister as defined in claim 16 further comprising a resilient gasket positioned between said cover and the open top of said container.

20. The canister as defined in claim 19 wherein said gasket is made of rubber material.

21. An airtight canister comprising:

a. a container having an open top and an annular groove remote from the top;

b. a cover;

c. a connecting means attached to said cover;

d. an elongated cord having two ends elastically attached to said connecting means such that a tension is created on the cord; and e. a retaining means attached to said cord at a portion between said two ends;

f. whereby when said cover is placed onto the open top of said container and said retaining means is retained by said annular groove of said container, the tension of said elongated cord will maintain a pressure on said cover which in turn creates an airtight coverage.

22. The canister as defined in claim 21 wherein said connecting means is a generally "$\pi$"-shaped member having a hollow crossing bar portion for retaining a coil spring interconnected between said two ends of said elongated cord and two standing joint portions integrally connected to the crossing bar portion for attachment with said cover at two spaced apart locations.

* * * * *